United States Patent [19]

Walter

[11] Patent Number: 4,855,277

[45] Date of Patent: Aug. 8, 1989

[54] THERMOSENSITIVE RECORDING MATERIAL HAVING RECORDING LAYER CONTAINING FLUORESCENT DYE

[75] Inventor: Philip G. Walter, Dayton, Ohio

[73] Assignee: Hobart Corporation, Troy, Ohio

[21] Appl. No.: 188,091

[22] Filed: Apr. 27, 1988

Related U.S. Application Data

[63] Continuation of Ser. No. 874,950, Jun. 16, 1986, abandoned.

[51] Int. Cl.[4] ..... B41M 5/18

[52] U.S. Cl. ..... 503/204; 427/150; 427/151; 427/152; 428/40; 428/690; 428/913; 428/914; 503/214; 503/226

[58] Field of Search ..... 427/150–152; 503/200, 204, 226, 214, 225; 428/40, 690, 913, 914

[56] References Cited

U.S. PATENT DOCUMENTS

| | | | |
|---|---|---|---|
| 4,093,460 | 6/1978 | Weinstein | 403/396 |
| 4,165,163 | 9/1979 | Lemanski | 354/122 |
| 4,208,811 | 6/1980 | Junowicz | 430/396 |
| 4,272,186 | 6/1981 | Plummer | 430/396 |
| 4,284,715 | 8/1981 | Horst | 430/396 |
| 4,298,274 | 11/1981 | Rees et al. | 355/71 |
| 4,301,232 | 11/1981 | Kullen et al. | 430/396 |
| 4,374,911 | 2/1983 | Hartley | 430/4 |
| 4,388,362 | 6/1983 | Iwata et al. | 427/150 |
| 4,423,939 | 1/1984 | Hayles | 354/122 |
| 4,440,840 | 4/1984 | Yamaguchi | 430/4 |
| 4,600,666 | 7/1986 | Zink | 430/396 |
| 4,626,877 | 12/1986 | Arai | 427/152 |
| 4,644,374 | 2/1987 | Hiraishi et al. | 346/209 |
| 4,647,951 | 3/1987 | Yamori et al. | 346/200 |

*Primary Examiner*—Bruce H. Hess

*Attorney, Agent, or Firm*—Biebel, French & Nauman

[57] ABSTRACT

A thermosensitive recording material having a fluorescent color comprising a support, a thermosensitive recording layer formed on one side of the support, the thermosensitive recording layer comprising (i) a thermosensitive recording system capable of producing color upon application of heat thereto and (ii) a colored fluorescent dye composition by which the recording material has high recognition ability; and optionally an adhesive layer formed on the opposite side of the support.

16 Claims, No Drawings

THERMOSENSITIVE RECORDING MATERIAL HAVING RECORDING LAYER CONTAINING FLUORESCENT DYE

This is a continuation of co-pending application Ser. No. 874,950, filed June 16, 1986, now abandoned.

The present invention relates to a thermosensitive recording material in which the recording layer contains a fluorescent dye composition.

A conventional thermosensitive recording material comprises a support, for example, a sheet of ordinary paper or synthetic paper and a thermosensitive recording layer formed on the support. Colored images are formed in the recording layer by image-wise application of heat. Thermal printers provided with a thermal print head, thermal pens and infrared application devices are generally used to print on thermosensitive recording materials.

Because of their ability to form colored images by simple application of heat, such thermosensitive recording materials are widely used, not only for copying books and documents, but also for recording output information from computers, facsimile apparatus, telex and other information transmission and measuring instruments. Furthermore, such thermosensitive recording materials are employed as railway tickets and as adhesive labels for the POS (point of sales) system in supermarkets and department stores.

As a thermosensitive recording adhesive label comprising the above-mentioned thermosensitive recording material, there is known a thermosensitive recording adhesive label comprising a support, a thermosensitive recording layer formed on the front side of the support, an adhesive layer formed on the back side of the support opposite the thermosensitive recording layer, and a disposable backing sheet which is attached to the adhesive layer and which can be peeled from the adhesive layer when the thermosensitive recording adhesive label is used.

Such a thermosensitive adhesive label can be attached to a variety of commercial products. By thermally printing, for instance, a product name, price and bar code on the label, and applying the thermally printed label to products with the backing sheet removed, customers can tell from the label the name and price of the product and other information concerning the product. The thermally printed bar codes can be read by automatic reading apparatus and the information processed by computer, so that, for instance, the sale, stock and reorder of the product can be controlled. Furthermore, the label can be used for other purposes, for instance, as a merchandising marker by which customers can readily distinguish particular products from other products, for instance, for quickly identifying specially discounted products.

To improve product recognition, conventionally, a method of printing graphics, numbers, letters and bar codes with a color ink on a white thermosensitive recording label has been employed. A method of printing such figures or bar codes on a label coated with a fluorescent ink containing a fluoresent dye or pigment has also been employed. The former method, however, has the shortcomings that printing by a color ink is time-consuming and costly and the printed portions result in the formation of dust which adheres to a thermal print head in the course of thermal printing, whereafter the thermally printed portions can become smeared with such dust. When the bar code is pre-printed on the label to overcome this problem in part, there is the disadvantage that a necessary quantity of such pre-printed bar-code labels must be stocked for each product in advance.

When such thermosensitive recording adhesive labels are employed, particularly in food packaging, they may come into contact with oils (for instance, oils contained in foods) and plasticizers (for instance, plasticizers contained in plastic wrapping film). When the developed colored images come into contact with such oils and placticizers, they are frequently discolored or become blurred. Therefore, it is required that thermally printed images be prevented from being dicolored or becoming blurred even if they are brought into contact with such adverse materials.

SUMMARY OF THE INVENTION

It is an object of the present invention to provide a thermosensitive recording material having a high recognition function, which can be produced without difficulty and can be easily used in practice.

Another object of the present invention is to provide a thermosensitive recording material which is useful in reproducing a bar code having improved scannability.

Still another object of the present inention is to provide a thermosensitive recording adhesive label having a high recognition function, which does not form dust which adheres to a thermal head such that the thermally printed portions on the label are not smeared.

A further object of the present invention is to provide a thermosensitive recording adhesive label having a high recognition function, which is particularly useful in food packaging and is capable of forming images which are not discolored and do not become blurred, even if the images come into contact with oils and plasticizers.

These and other objects are achieved in the present invention which provides:

A thermosensitive recording material comprising a support and a thermosensitive recording layer formed on one side of said support, said thermosensitive recording layer comprising (i) a thermosensitive recording system capable of producing a color upon application of heat thereto and (ii) a colored fluorescent dye composition.

More particularly, the present invention relates to a recording material having a high recognition function which is useful in labeling a product and which is provided with a layer of an adhesive on the side of the support opposite the thermosensitive recording layer. When necessary or desirable, a disposable backing sheet can be provided on the adhesive layer and peeled from the adhesive layer prior to application.

The recording material of the present invention may also include a barrier layer which may be applied over the thermosensitive recording layer or to the back of the support to protect the layer from materials which could discolor the images developed in the layer. A front barrier layer also improves thermal head life. A back barrier layer can be interposed between the support member and the optional adhesive layer in order to protect further the thermosensitive recording layer from adverse materials which may discolor the images developed in the thermosensitive layer. This is desirable when the thermosensitive label is applied to a material such as a plastic foil which contains agents such as plasticizers which may cause dicoloration.

DETAILED DESCRIPTION OF THE PREFERRED EMBODIMENTS

An embodiment of a thermosensitive recording material according to the present invention comprises (a) a support, (b) a thermosensitive recording layer formed on one side (the display side or front) of the support, which thermosensitive recording layer includes (i) a thermosensitive recording system capable of forming a color upon image-wise application of heat thereto and (ii) a colored fluorescent dye composition. In accordance with the preferred and most typical embodiment of the invention, the recording material additionally includes (c) an adhesive layer formed on the back side of the support member, opposite the thermosensitive recording layer.

As the support, any support materials that are employed in conventional thermosensitive recording materials can be employed in the present invention. Cellulosic and synthetic papers are most typically used.

As the thermosensitive recording system employed in the thermosensitive recording layer, a thermosensitive recording composition comprising a combination of a leuco dye and a color developer is preferably employed. These compositions are well known and readily available in this art.

Specific examples of leuco dyes that can be employed in the thermosensitive recording system are as follows:

3-[N-(p-tolylamino)]-7-anilinofluoran,
3-[N-(p-tolyl)-N-methylamino]-7-anilinofluoran,
3-[N-(p-toyl)-N-ethylamino]-7-anilinofluoran,
3-[N-(p-tolyl)-N-propylamino]-7-anilinofluoran,
3-dimethylamino-6-methyl-7-anilinofluoran,
3-diethylamino-6-methyl-7-anilinofluoran,
3-dipropylamino-6-methyl-7-anilinofluoran,
3-dibutylamino-6-methyl-7-anilinofluoran,
3-pyrrolidino-6-methyl-7-anilinofluoran,
3-piperidino-6-methyl-7-anilinofluoran,
3-piperazino-6-methyl-7-anilinofluoran,
3-N-(N'-methylpiperazino)-6-methyl-7-anilinofluoran,
3-morpholino-6-methyl-7-anilinofluoran,
3-dibenzylamino-6-methyl-7-anilinofluoran,
3-(N-methyl-N-cyclohexyl)-6-methyl-7-anilinofluoran, and
3-(N-cyclohexylamino)-6-methyl-7-anilinofluoran.

Specific examples of color developers that can be employed in the thermosensitive coloring composition are as follows:

2,2'-methylenebis(4-ethyl-6-t-butylphenol),
2,2'-methylenebis(4-methyl-6-t-butylphenol),
4,4'-isopropylidenediphenol,
4,4'-isopropylidenebis(2-chlorophenol),
4,4'-isopropylidenebis(2,6-dibromophenol),
4,4'-isopropylidenebis(2,6-dichlorophenol),
4,4'-isopropylidenebis(2-methylphenol),
4,4'-isopropylidenebis(2,6-dimethylphenol),
4,4'-isopropylidenebis(2-t-butylphenol),
4,4-sec-butylidenediphenol,
4,4'-sec-butylidenebis(2-methylphenol),
4,4'-cyclohexylidenediphenol,
4,4'-cyclohexylidenebis(2-methylphenol),
2,2'-thiobis(4,6-dichlorophenol) and
4,4'-(1-methyl-n-hexylidene)diphenol.

In the thermosensitive recording layer, conventional binder agents are also employed. Examples of such binder agents are gelatin, starch, hydroxyethylcellulose, polyacrylic acid, carboxyethylcellulose, methoxycellulose, polyvinyl alcohol and polyvinyl pyrrolidone. Further, conventionally employed inorganic and organic fillers and sensitizer agents can be used to improve the thermal head matching properties of the thermosensitive layer.

Fluorescent dyes are preferably incorporated in the thermosensitive recording layer as a resin grind, i.e., as a pulverized composition of a fluorescent dye and a resin.

Specific examples of fluorescent dyes for use in the pulverized fluorescent dye composition are Thioflavine (C.I. 49005), Fluorescein (C.I. 35350), Billiant sulfoflavine FF (C.I. 56205), Basic Yellow HG (C.I. 46040), Eosine (C.I. 45380), Rhodamine 6G (C.I. 45160) and Rhodamine B (C.I. 45170).

Specific examples of synthetic resins for use in the pulverized fluorescent dye composition are acrylic resin, polyester resin, polyamide resin, polyvinyl chloride resin, alkyd resin, aromatic sulfonamide resin, urea resin, melamine resin, benzoguanamine resin and copolymers thereof.

The pulverized fluorescent dye composition can be prepared by dyeing such a resin with one of the above mentioned fluorescent dyes in the course of preparation of the resin (for instance, in the course of emulsion polymerization to prepare the resin in the presence of such fluorescent dye) or by dissolving such a fluorescent dye in one of the resins to form a solid solution, followed by pulverizing the colored resin.

It is preferable that the average particle size of the pulverized fluorescent dye composition be in the range of from 0.5 $\mu$m to 5 $\mu$m.

It is preferable that the amount of the fluorescent dye composition be in the range of from 15 wt.% to 60 wt. %, more preferably in the range of from 35 wt. % to 50 wt %, to the entire weight of the thermosensitive recording layer.

In the adhesive layer, any conventional adhesive agents can be employed. For example, acrylic adhesive agent, starch adhesive agent and styrene-butadiene latex can be employed. Other pressure-sensitive adhesives as conventionally used in adhesive labels may also be employed herein.

For convenience, a disposable backing sheet such as silicone coated paper can be attached to the adhesive layer when present, which can be peeled from the adhesive layer when the thermosensitive recording material is used.

In order to protect the thermosensitive recording layer from adverse materials such as oils and plasticizers which may discolor the images developed in the layer, a front barrier layer comprising a water-soluble polymeric material can be formed on the thermosensitive layer. Specific examples of the water-soluble polymeric materials are polyvinyl alcohol, carboxymethylcellulose, methylcellulose, ethylcellulose, hydroxymethylcellulose, hydroxyethylcellulose, hydroxypropylcellulose, polyacrylamide, starch, gelatin, casein and polyvinyl pyrrolidone. Resins dispersed in water, for instance, polystyrene emulsion, can also be employed.

In order to make the front barrier layer waterproof, the following waterproof agents can be employed: formaldehyde resin, polyamide resin and polyamide-epichlorohydrin resin.

Further, when the front barrier layer is formed on the thermosensitive layer, conventionally employed inorganic and organic fillers can be incorporated in the front barrier layer in order to improve the thermal head matching properties of the front barrier layer.

For the same purpose as that of the front barrier layer, that is, for protecting images formed in the thermosensitive layer, a barrier layer can also be provided on the back side of the support member comprising substantially the same components as the front barrier layer.

By referring to the following examples, the present invention will now be explained in more detail.

EXAMPLE 1

Preparation of Coloring Liquid (Liquid A) and Color Developer Liquid (Liquid B)

The following Liquid A and Liquid B were prepared by grinding the respective components in a ceramic ball mill for 24 hours:

| | Parts by Weight |
|---|---|
| Liquid A | |
| 3-(N—ethyl-N—p-tolyl)amino-6-methyl-7-anilinofluoran | 150 |
| 5% aqueous solution of polyvinyl alcohol | 150 |
| Water | 200 |
| Liquid B | |
| Bisphenol A | 120 |
| Stearamide | 120 |
| 5% Aqueous solution of polyvinyl alcohol | 120 |
| Water | 200 |

Preparation of Fluorescent Dye Composition Liquid (Liquid C)

A mixture of the following components was dispersed in a ceramic ball mill until the average particle size of the fluorescent composition became 2 μm, whereby a fluorescent dye composition dispersion (Liquid C) was prepared.

| | Parts by Weight |
|---|---|
| Pulverized Fluorescent Dye Composition A (solid solution of Rhodamine B and melamine resin) | 100 |
| 10% aqueous solution of polyvinyl alcohol | 100 |
| Dispersing agent (dialkyl sodium sulfosuccinate) | 1 |
| Water | 100 |

Preparation of Thermosensitive Recording Layer Coating Composition 100 parts by weight of Liquid A, 400 parts by weight of Liquid B and 150 parts by weight of Liquid C were mixed and dispersed, whereby a thermosensitive recording layer coating composition was prepared.

The thus prepared thermosensitive recording layer coating composition was coated on a sheet of commercially available high quality paper (having a basis weight of 52 g/m$^2$) with a coating weight of 10 g/m$^2$ when dried, so that a thermosensitive recording layer containing the above mentioned fluorescent dye composition was formed on the high quality paper.

Preparation of Front Barrier Layer Coating Composition (Liquid D)

A mixture of the following components was dispersed in a ceramic ball mill, whereby a front barrier layer coating composition (Liquid D) was prepared:

| | Part by Weight |
|---|---|
| Carboxyl-group-modified polyvinyl alcohol | 50 |
| Urea - formaldehyde resin filler | 10 |
| Polyamide epichlorohydrin resin | 5 |
| Water | 500 |

The thus prepared front barrier layer coating composition (Liquid D) was coated on the thermosensitive recording layer with a coat weight of 3 g/m$^2$ when dried, whereby a front barrier layer was formed on the thermosensitive recording layer. Thereafter, the front barrier layer was subjected to calendering to make the surface of the front barrier layer smooth.

An acrylic adhesive agent was applied to the back side of the support member, so that an adhesive layer was formed.

A silicone-resin-coated disposable backing sheet was attached to the above formed adhesive layer, whereby a thermosensitive recording adhesive label No. 1 according to the present invention was prepared.

By a commercially available thermal printer with a thermal head built therein, thermal printing was performed on the thermosensitive recording adhesive layer No. 1. As a result, clear black images were formed on the adhesive label with a fluorescent orange background having remarkable recognition effect.

EXAMPLE 2

Example 1 was repeated except that the fluorescent dye composition dispersion, Liquid C, employed in Example 1 was replaced by 300 parts by weight of the following fluorescent dye composition dispersion, Liquid E, whereby a thermosensitive recording adhesive label No. 2 according to the present invention was prepared.

Preparation of Liquid E

A fluorescent composition dispersion (Liquid E) was prepared by preparing a 50% aqueous dispersion of a solid solution of Rhodamine B and acrylic resin.

Thermal printing was performed on the thermosensitive recording adhesive layer No. 2. As a result, clear black images were formed on the adhesive label with a fluorescent orange background having a remarkable recognition effect.

What is claimed is:

1. A thermosensitive recording material comprising:

a support and a thermosensitive recording layer formed on one side of said support, said thermosensitive recording layer including (i) a thermosensitive recording system capable of producing a colored image upon application of heat thereto, and (ii) a colored fluorescent dye composition, said system also comprising a resin, said resin being dissolved in the form of a solid solution with said fluorescent dye, said colored flourescent dye forming a background for said image.

2. The thermosensitive recording material as claimed in claim 1 further comprising an adhesive layer provided on the side of said support opposite said thermosensitive recording layer.

3. The thermosensitive recording material as claimed in claim 2, further comprising a front barrier layer formed on said thermosensitive recording layer, said front barrier layer comprising a water-soluble polymeric material capable of preventing intrusion of materials which may discolor the color produced in said thermosensitive recording layer.

4. The thermosensitive recording material as claimed in claim 2, further comprising a disposable backing sheet which is attached to said adhesive layer and removed from said adhesive layer when said thermosensitive recording material is used.

5. The thermosensitive recording material as claimed in claim 2, comprising a back barrier layer formed between the back side of said support and said adhesive layer, said back barrier layer comprising a water-soluble polymeric material capable of preventing intrusion of materials which may discolor the color produced in said thermosensitive recording layer.

6. The thermosensitive recording material as claimed in claim 2 wherein said adhesive layer includes a pressure-sensitive adhesive.

7. The thermosensitive recording material as claimed in claim 1, wherein said thermosensitive recording system is a combination of a leuco dye and a color developer.

8. The thermosensitive recording material as claimed in claim 1, wherein the amount of said colored fluorescent dye composition is in the range of from 15 wt. % to 60 wt % to the entire weight of said thermosensitive recording layer.

9. The thermosensitive recording material as claimed in claim 1 wherein said fluorescent dye is orange.

10. The thermosensitive recording material as claimed in claim 1 wherein said support is paper.

11. A thermosensitive recording material comprising:

a support and a thermosensitive recording layer formed on one side of said support, said thermosensitive recording layer including (i) a thermosensitive recording system capable of producing a colored image upon application of heat thereto, and (ii) a colored fluorescent dye composition, said system also comprising a resin, said resin being dissolved in the form of a solid solution with said fluorescent dye, said colored fluorescent dye forming a background for said image.

12. The thermosensitive recording material as claimed in claim 11 further comprising an adhesive layer provided on the side of said support opposite said thermosensitive recording layer.

13. The thermosensitive recording material as claimed in claim 12 wherein said barrier layer is a front barrier layer formed on said thermosensitive recording layer, said front barrier layer comprising a water-soluble polymeric material capable of preventing intrusion of materials which may disolor the color produced in said thermosensitive recording layer.

14. The thermosensitive recording material as claimed in claim 12 further comprising a disposable backing sheet which is attached to said adhesive layer and removed from said adhesive layer when said thermosensitive recording material is used.

15. The thermosensitive recording material as claimed in claim 12 wherein said barrier layer is a back barrier layer formed on the back side of said support, said back barrier layer comprising a water-soluble polymeric material capable of preventing intrusion of materials which may discolor the color produced in said thermosensitive recording layer.

16. The thermosensitive recording material as claimed in claim 11 wherein the amount of said colored fluorescent dye composition is in the range of from 15 wt. % to 60 wt % to the entire weight of said thermosensitive recording layer.

* * * * *